US008505687B2

(12) United States Patent
Allam

(10) Patent No.: US 8,505,687 B2
(45) Date of Patent: Aug. 13, 2013

(54) PLAY STRUCTURE SAFETY DEVICE

(76) Inventor: Dominic J. Allam, Canton, MI (US)

( * ) Notice: Subject to any disclaimer, the term of this patent is extended or adjusted under 35 U.S.C. 154(b) by 212 days.

(21) Appl. No.: 12/953,804

(22) Filed: Nov. 24, 2010

(65) Prior Publication Data

US 2012/0125714 A1 May 24, 2012

(51) Int. Cl.
*E06C 7/00* (2006.01)

(52) U.S. Cl.
USPC ..... 182/106; 182/129; 182/230

(58) Field of Classification Search
USPC ..... 182/106, 129, 230; 150/154, 158; 5/100; 229/87.01, 800; 446/71, 75, 76, 476, 446/478, 482
See application file for complete search history.

(56) References Cited

U.S. PATENT DOCUMENTS

| | | | | | |
|---|---|---|---|---|---|
| 2,620,185 | A * | 12/1952 | Harding | 482/35 |
| 2,880,829 | A * | 4/1959 | Watkins | 52/101 |
| 3,311,195 | A * | 3/1967 | Singer | 182/230 |
| 4,126,206 | A * | 11/1978 | Becnel | 182/129 |
| 4,181,195 | A * | 1/1980 | Clarke | 182/230 |
| 4,579,197 | A * | 4/1986 | Spurling | 182/106 |
| 5,086,543 | A * | 2/1992 | Mitchell | 24/16 PB |
| 5,246,401 | A * | 9/1993 | Boatwright | 472/116 |
| 5,441,126 | A * | 8/1995 | Orrick | 182/106 |
| 5,505,663 | A * | 4/1996 | Goulart et al. | 472/116 |
| 5,557,817 | A * | 9/1996 | Haddock | 5/663 |
| 5,605,205 | A * | 2/1997 | Douglas et al. | 182/198 |
| 5,682,960 | A * | 11/1997 | Mobley et al. | 182/129 |
| 6,516,546 | B1 * | 2/2003 | Bremick | 40/124.01 |
| 6,581,505 | B1 * | 6/2003 | Levell | 89/36.07 |
| 6,626,491 | B1 * | 9/2003 | Blome et al. | 297/229 |
| 7,340,788 | B1 * | 3/2008 | Traub | 5/697 |
| 7,717,231 | B2 * | 5/2010 | Horton | 182/106 |
| 7,793,759 | B1 * | 9/2010 | Aiken, Jr. | 182/106 |
| 7,941,950 | B2 * | 5/2011 | Leeds | 40/606.01 |
| 8,191,682 | B2 * | 6/2012 | Lipniarski | 182/113 |
| 2005/0263093 | A1 * | 12/2005 | Rosen | 119/524 |
| 2007/0130875 | A1 * | 6/2007 | Detal | 52/650.3 |
| 2011/0072574 | A1 * | 3/2011 | Hsiang Lin | 4/504 |

* cited by examiner

*Primary Examiner* — Alvin Chin Shue
*Assistant Examiner* — Colleen M Chavchavadze
(74) *Attorney, Agent, or Firm* — Warn Partners, P.C.

(57) ABSTRACT

Many family homes, school and municipal parks have play structures for children. Typically these playground play structures have ladders. In the case of family homes in particular, toddlers typically enjoy climbing the ladders but then are stuck at the top and in danger of falling off the ladder. In order to prevent toddlers from climbing the ladder of the play structures when unattended by an adult, and ultimately preventing injury, an invention that prevents the ladder from being climbed by a toddler is presented here.

4 Claims, 4 Drawing Sheets

PLAY STRUCTURE SAFETY DEVICE

FIELD OF THE INVENTION

This invention is in the field of child safety and security.

BACKGROUND OF THE INVENTION

Unencumbered access to playground ladders by toddlers can result in tragic accidents especially when adults are not present to supervise play on ladders. Although in the majority of instances there is no accident, when a fall by a toddler from ladder does occur it can result in serious injuries that require medical attention. Additionally, adults or other persons could injure themselves rushing to reach a child who has climbed on to a ladder.

The above problems occur in a variety of settings including homes, schools or municipal parks. It is therefore desirable to secure play structure ladders from being climbed on when a school play area is not in use or supervised. Currently there is no cost effective solution other than removing the ladder should a school wish to pursue this option.

It is desirable to prevent unsupervised ladder climbing on play structures by children not capable of safely climbing on the ladders.

SUMMARY OF INVENTION

The invention is a safety sheet device having of a long sheet of thin plastic or other material, such as polyurethane foam, in sufficient length capable of spanning the ladder rungs and wide enough to make the ladder unusable when attached. Another objective of the present invention is to provide a safety sheet device that is made of polymer, colorants and UV light absorbers that can be safely handled and non-toxic to adults and children.

In one embodiment of the invention, the safety sheet device has a tying or attachment mechanism that allows one end to be snapped into place or mechanically fastened to the opposite end after it has been wrapped around the ladder.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
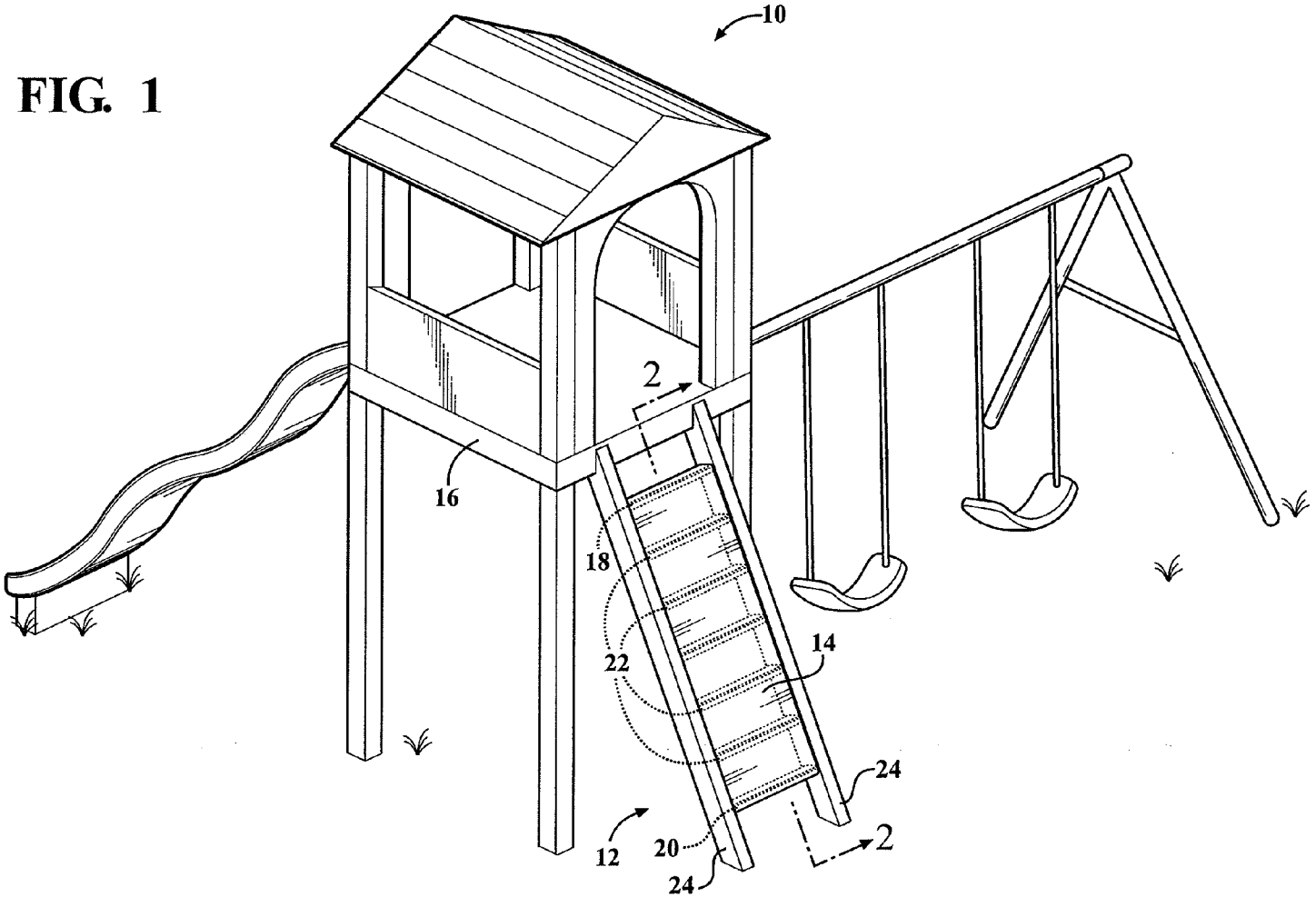
FIG. 1 is a perspective view of a play structure having a ladder.

Referring now to FIG. 1 of the present application, a play structure arrangement 10 is shown. The play structure arrangement 10 has a platform 16 with a ladder 12 connected. A safety sheet device 14 is shown connected to the ladder 12. The play structure arrangement 10 can have many different forms, but generally includes a platform 16, or a place where the ladder 12 is connected in addition some other sort of device. In the present example, the play structure arrangement 10 includes a slide connected to the platform 16 which is elevated off of the ground on posts. Other play apparatuses can be connected. For example, as shown in FIG. 1, there are two swings that form part of the play structure arrangement 10. It is also within the scope of this invention for the safety sheet device 14 to be used for other ladders that are not necessarily connected to a platform 16. For example, a play structure commonly referred to as "monkey bars" has a ladder that is not always connected to a platform. It is within the scope of the invention for the safety sheet device 14 to be used on any type of ladder including work ladders, pool ladders, loft ladders, etc.

Figure 2:
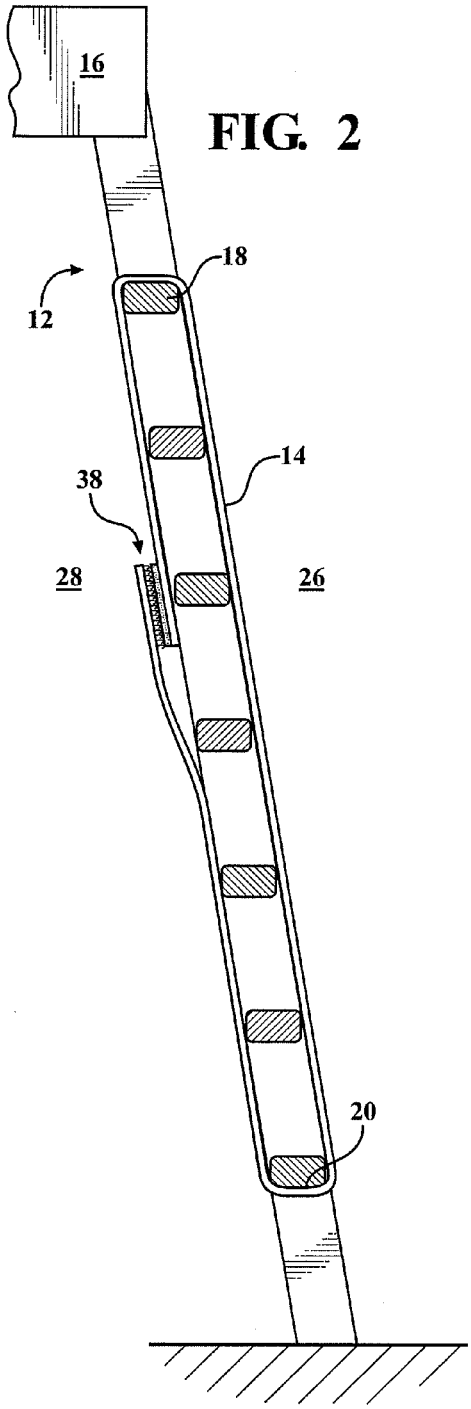
FIG. 2 is a cross-sectional side view of a play structure ladder with a safety sheet device connected in accordance with one embodiment of the invention.

Referring to FIGS. 1-2, the connection of the safety sheet device 14 to the ladder 12 is described. As shown in FIG. 1, the ladder 12 has a top rung 18, bottom rung 20, and a plurality of rungs 22 positioned between the top rung 18 and the bottom rung 20. All of the rungs 18, 20, 22 are connected between at least two stringers 24. It is within the scope of this invention for a greater or lesser number of stringers 24 to be used as well as a greater or lesser number or rungs 18, 20, 22. The ladder 12 further includes a front side 26 and a back side 28. The front side 26 is the side of the ladder 12 that the user will climb up to gain access to the platform 16 of the play structure 10.

Figure 7:
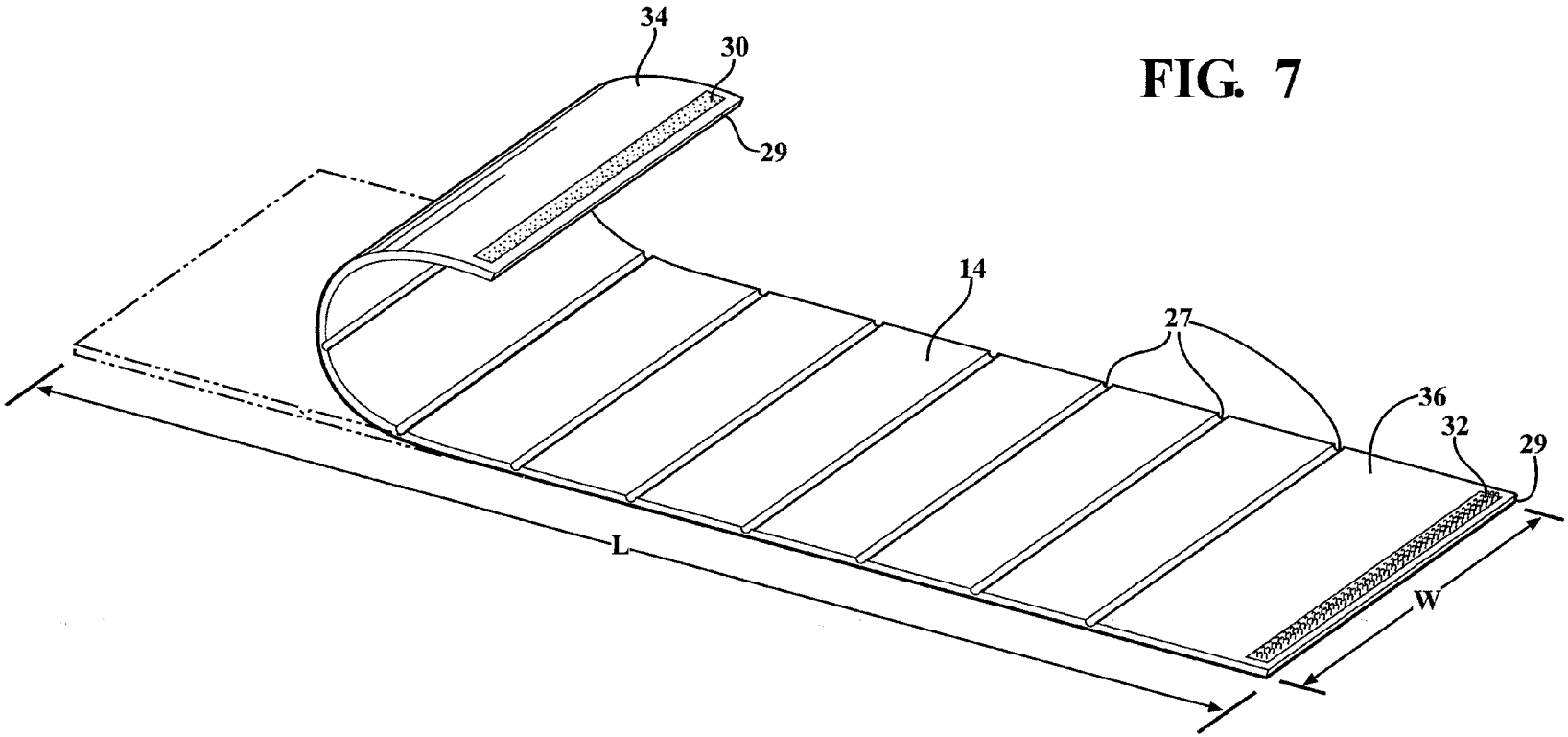
FIG. 7 is a perspective view of the safety sheet device.

Referring briefly to FIG. 7, the structure of the safety sheet device 14 is shown and described. The safety sheet device 14 has a suitable length "L" for connection to the play structure 10, shown in FIG. 1. The safety sheet device 14 also has a width "W" that is of sufficient size to extend across the ladder 12 between the stringers 24, shown in FIG. 1. However, it is possible to use a safety sheet device 14 that has a width that does not extend entirely between the stringers 24, but rather is of sufficient width to render the ladder 12 unusable. The length "L" of the safety sheet device 14 will depend upon the height or length of the ladder 12 as well as the particular embodiment of the safety sheet device being used. The safety sheet device 14 is made of a flexible polymer material that includes plastics generally, as well as specific polymers from the group including polyurethane foam, polyamides, polyesters, neoprene, nitrile rubber, styrenes, and vinyl. Additionally non-toxic colorants such as clay, mica and calcium carbonate combined with the various polymer resins are used to enhance the safety of the polymer-colorant system when the safety sheet device 14 is handled. Additional possible materials include UV light absorbers, such as Milestab 81™ (2-Hydroxy-4-Octyloxy Benzophenone) from MPI Chemie of the Netherlands, can be added to the polymer matrix to increase the resistance of the safety sheet from destruction from sunlight. The safety sheet device 14 shown in FIG. 7 also includes a plurality of optional flutes 27 that may be molded into the safety sheet device 14 to provide points of flexation.

The flutes 27 are optional and it is within the scope of this invention for the safety sheet device 14 to not have the flutes 27. The safety sheet device shown in FIG. 7 has opposite ends 29 located at each end of the length "L". Located at or near the opposite ends 29 are fasteners 30, 32 that are used to secure the safety sheet device 14 in place. FIG. 7 depicts a hook and loop or Velcro™ fastener arrangement that includes a first fastener 30 and a second fastener 32 located near the opposite ends 29 of the safety sheet device 14. The first fastener 30 is connected to a first surface 34 of the safety sheet device 14 while the fastener 32 is connected to a second surface 36 of the safety sheet device 14 opposite the first surface 34. Placement of the first and second fasteners 30, 32 on the respective first and second surfaces 34, 36 allows for the two opposite ends 29 of the safety sheet device 14 to overlap at a connect area 38 for wrapping the safety sheet device 14 in a circular or loop shaped position around the top rung 18 and bottom rung 20 of the ladder 12. This is shown in FIG. 2.

FIG. 2 shows one embodiment of the safety sheet device 14 where the safety sheet device 14 wraps around the top rung 18 and bottom rung 20 and is connected together at the connect area 38 on the backside 28 of the ladder 12 using the fasteners 30, 32. It is within the scope of this invention for the connect area 38 to be located on the front side 26 of the ladder 12 depending on the particular application. Wrapping the safety sheet device 14 around the top rung 18 and bottom rung 20 of the ladder 12 using the hook and loop fasteners 30, 32 renders the ladder 12 immobile since a small child, such as a toddler or infant, cannot access the covered rungs 18, 20, 22 of the ladder. While FIG. 2 depicts the safety sheet device 14 covering all of the rungs of the ladder 12, it is also within the scope of the invention for a lesser number of rungs to be covered by the safety sheet device 14. Additionally, depending on the number of rungs 18, 20, 22 on the ladder 12, the length "L" of the safety sheet device can be varied either by manually trimming the safety sheet device 14 or having different sized safety sheet devices available for covering a number of different rungs. The size of the fasteners or the number of fasteners 30, 32 can also be varied to provide a means of adjusting the size of the safety sheet device 14 when it is connected to the ladder 12.

Figure 3:
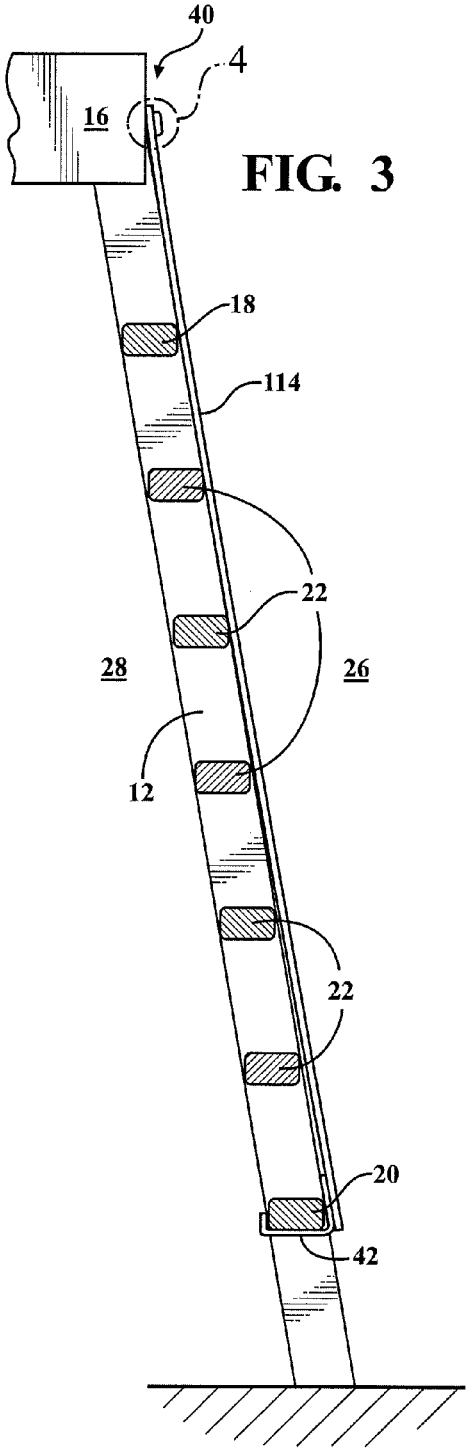
FIG. 3 is a cross-sectional side view of a play structure ladder with a safety sheet device connected in accordance with a second embodiment of the invention.

Referring to FIG. 3, an alternate embodiment of the invention is shown which includes a safety sheet device 114 that does not wrap around the top and bottom rungs 18, 20 of the ladder 12, but rather covers just the front side 26 of the ladder 12. This particular embodiment of the safety sheet device 114 attaches to the platform 16 at a first connection 40. The second end of the safety sheet device has a second connection 42 that is used to connect to the bottom rung 20 of the ladder 12.

Figure 4:
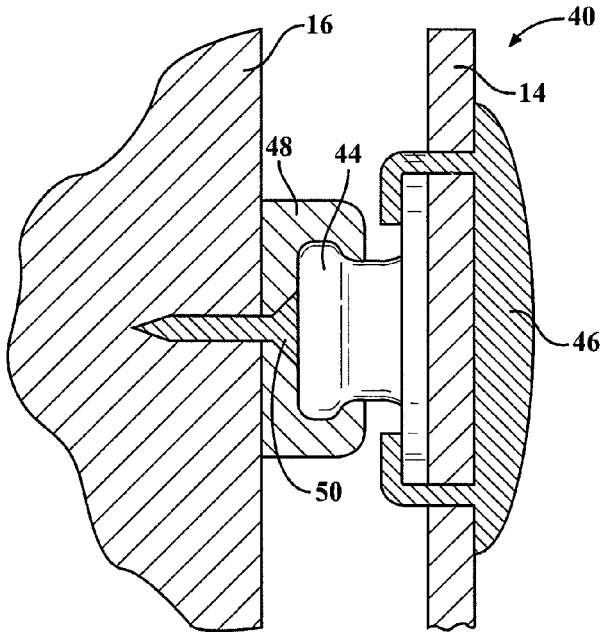
FIG. 4 is an exploded cross-sectional view of an alternate arrangement for connecting the safety sheet device to the play structure.

Referring now to FIG. 4, an exploded cross-sectional view of the first connection 40 is shown. The first connection 40 in this particular embodiment of the invention is a snap fastener having a male half 44 connected to the safety sheet device 14 using a retainer 46. A female half 48 of the snap fastener is connected to the platform 16 using a fastener 50. While the female half 48 is shown as being fastened to the platform 16, it is within the scope this invention for a female half 48 to be connected another structure aside from the platform 16 and connected to other alternate structures such as the stringers 24 or other structures. Also, it is within the scope of this invention for multiple snap fasteners to be used even though only a single snap fastener is shown. The female half 48 is configured to receive and retain the male half 44.

Figure 6:
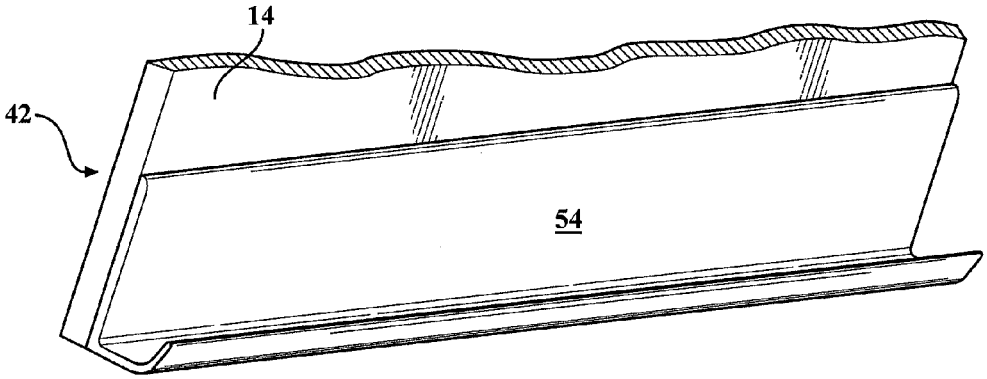
FIG. 6 is an exploded perspective view of another alternate connection arrangement for the safety sheet device.

Referring now to FIG. 6, an exploded perspective view of the second connection 42 is shown. The second connection includes an L-clamp 54 that is connected to the safety sheet device 14. The L-clamp 54 is shaped to resiliently clamp or grasp the bottom rung 20 of the ladder 12. While FIG. 3 shows the second connection 42 being connected to the bottom rung 20, it is within the scope of this invention for the connection to be made with any of the rungs 18, 20, 22. It is also within the scope of this invention for both the first connection 40 and second connection 42 to consist of two L-clamps 54 connected to the safety sheet device 14, where the safety sheet device 14 would be stretched between the top rung 18 and bottom rung 20, or between any two of the rungs 18, 20, 22 of the ladder 12. It is also within the scope of the invention for the L-claims 54 to have a different shape depending on the cross-sectional shape of the rungs 18, 20, 22.

Figure 5:
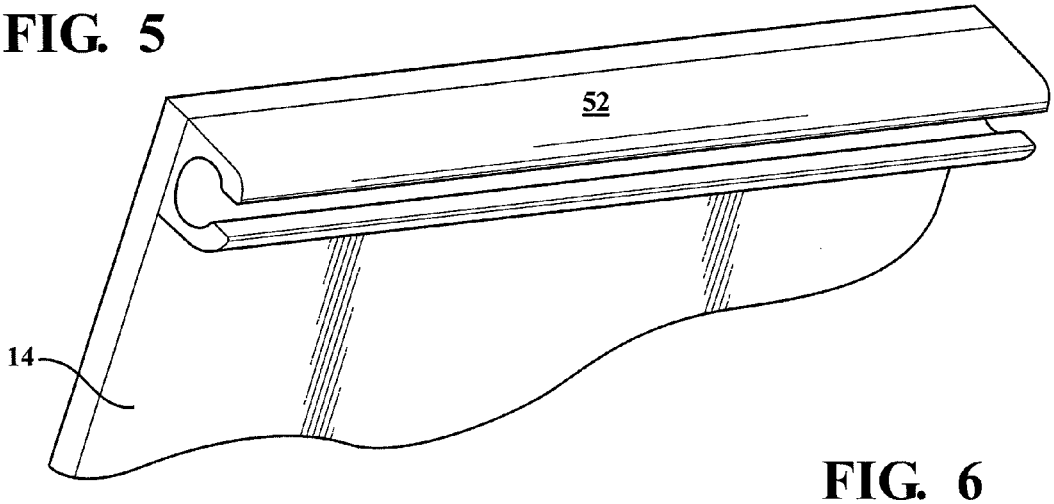
FIG. 5 is an exploded perspective view of an alternate attachment arrangement for the safety sheet device.

Referring now to FIG. 5, an additional alternate connection that can be used for the first connection 40 and second connection 42 are shown. This particular alternate connection uses a C-clamp 52 connected to the safety sheet device 14. The C-clamp 52 can be used near both of the opposite attachment ends 29 or various combinations of the different connections described herein can be used. The C-clamp 52 is shaped to resiliently clamp on or grasp one of the rungs 18, 20, 22. In the embodiments described in FIGS. 5 and 6, the C-clamp 52 or L-clamp 54 may be attached to the safety sheet device 14 using adhesives, fasteners or hook and loop connections as well as any other suitable attachment mechanism. Generally speaking, the fasteners or connections between the safety sheet device and the platform, stringers or rungs can be accomplished using buttons, snaps, hooks, magnets, clips and strings connected at the connect area 38, or between the rungs, platform, stringers or other structures.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A play structure arrangement comprising:

a play structure;

a ladder operatively connected to said play structure having a plurality of rungs, each connected between at least two rigid stringers, said ladder and said plurality of rungs having a front side and back side;

a safety sheet device formed of flexible polymer material removably connected to said ladder, said safety sheet device having a first side and second side and two opposite attachment ends, said first side and said second side having a length extending between said two opposite attachment ends, said length at least extends between said plurality of rungs and a width of said first side and said second side extending between said at least two rigid stringers; and wherein said length of said safety sheet device extends across the front side of said plurality of rungs, wraps around at least two of said plurality of rungs and extends across the back side of said plurality of rungs allowing said two opposite attachment ends to overlap and removably connect together using fasteners at a connection area.

2. The play structure of claim 1 wherein said safety sheet device has a plurality of flutes molded into said safety sheet device to create flexation points.

3. The play structure of claim 1 wherein said safety sheet device comprises one or more polymers selected from the group comprising:

polyurethane foam, polyamides, polyesters, neoprene, nitrile rubber, styrenes, and vinyl.

4. The play structure of claim 1 wherein said fasteners are hook and loop type fasteners connected to said first side and said second side of said safety sheet device and are arranged to create said connection area of the first side and second side of the safety sheet device when the safety sheet device is connected to the ladder, wherein said fasteners have an area size that provides adjustment of said overlap area to cover different size ladders and ladders having different amounts of space between said plurality of rungs.

* * * * *